US007523592B2

(12) United States Patent
Horwitz

(10) Patent No.: US 7,523,592 B2
(45) Date of Patent: Apr. 28, 2009

(54) HANDRAIL ASSEMBLY WITH PANEL AND ENGAGING SLEEVES

(75) Inventor: David James Horwitz, Savannah, GA (US)

(73) Assignee: Duracase Proprietary, LLC, Ridgeland, SC (US)

( * ) Notice: Subject to any disclaimer, the term of this patent is extended or adjusted under 35 U.S.C. 154(b) by 46 days.

(21) Appl. No.: 11/436,149

(22) Filed: May 17, 2006

(65) Prior Publication Data

US 2006/0283108 A1 Dec. 21, 2006

Related U.S. Application Data

(60) Provisional application No. 60/683,012, filed on May 20, 2005.

(51) Int. Cl.
*E04F 11/18* (2006.01)

(52) U.S. Cl. ..... 52/716.8; 52/185

(58) Field of Classification Search . 52/718.01–718.03, 52/716.1, 716.8, 184–186, 730.1, 720.1; 256/24–31, 73, DIG. 4; 248/251; 428/192, 428/157, 167

See application file for complete search history.

(56) References Cited

U.S. PATENT DOCUMENTS 2,531,967 A * 11/1950 Bishop ..... 293/120
2,567,554 A * 9/1951 Davey ..... 33/492
2,873,094 A * 2/1959 Blum ..... 256/31
3,071,350 A * 1/1963 Opie ..... 256/65.08
3,086,626 A * 4/1963 Bowers ..... 52/204.599
3,408,786 A * 11/1968 Snyker ..... 52/309.15
3,420,505 A * 1/1969 Jefferys ..... 256/22
3,591,213 A * 7/1971 Turner ..... 182/220
3,777,438 A * 12/1973 Brown ..... 52/718.04
3,825,229 A * 7/1974 Bartlett et al. ..... 256/59
3,842,564 A * 10/1974 Brown ..... 52/717.03
3,854,269 A * 12/1974 Hancock ..... 220/683
3,955,799 A * 5/1976 Lauzier ..... 256/21
3,973,756 A * 8/1976 Lauzier ..... 256/21
4,007,918 A * 2/1977 Matsubara ..... 256/59
4,014,520 A * 3/1977 Walters ..... 256/22
4,073,477 A * 2/1978 Walters ..... 256/22
4,102,529 A * 7/1978 Neblung et al. ..... 256/70
4,155,590 A * 5/1979 Cunningham ..... 297/215.15
4,200,261 A * 4/1980 Bartlett ..... 256/59
4,220,316 A * 9/1980 Naka et al. ..... 256/59
4,334,671 A * 6/1982 De Guise ..... 256/65.12
4,373,310 A * 2/1983 Dean ..... 52/182

(Continued)

FOREIGN PATENT DOCUMENTS

JP 4-277253 * 10/1992

(Continued)

*Primary Examiner*—Gay A Spahn
(74) *Attorney, Agent, or Firm*—J. Bennett Mullinax, LLC

(57) ABSTRACT

A handrail assembly is provided which may be attached to a wall or stairwell using conventional mounting hardware. The handrail consists of a substantially flat panel having a series of grooves on opposite sides of an upper edge and a lower edge of the panel. Within the respective oppositely spaced grooves, a thermoplastic extruded slit tube is inserted into the grooves providing a curved gripping portion of a handrail. The substantially flat panel has exterior surfaces of a thermoplastic polymer, thereby providing a handrail assembly having outer surfaces of a damage resistant, easily repair, long wearing polymer.

20 Claims, 4 Drawing Sheets

U.S. PATENT DOCUMENTS 4,390,164 A * 6/1983 Cokelekoglu ..... 256/65.13
4,586,697 A * 5/1986 Tornya ..... 256/65.11
4,676,469 A * 6/1987 Rotermund et al. ..... 248/243
4,690,383 A * 9/1987 Batcheller ..... 256/24
4,712,942 A * 12/1987 Brown ..... 403/174
4,750,713 A * 6/1988 Hirose ..... 256/69
4,920,717 A * 5/1990 Hooper, Jr. ..... 52/204.597
4,968,005 A * 11/1990 Zen ..... 256/22
5,099,402 A * 3/1992 Starniri ..... 362/146
5,165,643 A * 11/1992 Shreiner ..... 248/251
5,200,240 A * 4/1993 Baker ..... 428/34.1
5,209,541 A * 5/1993 Janotik ..... 296/29
D337,257 S * 7/1993 Danieli ..... D8/376
5,271,687 A * 12/1993 Holka et al. ..... 403/233
5,273,258 A * 12/1993 Bedics ..... 256/59
5,288,048 A * 2/1994 Shreiner ..... 248/251
5,364,077 A * 11/1994 Venegas et al. ..... 256/69
5,469,682 A * 11/1995 Knight ..... 52/718.01
5,497,895 A * 3/1996 Rudbach ..... 220/4.33
5,529,288 A * 6/1996 Cheng-I ..... 256/65.16
5,557,893 A * 9/1996 Bowls ..... 52/187
5,584,469 A * 12/1996 Goodwin ..... 256/67
5,649,688 A * 7/1997 Baker ..... 256/21
5,743,064 A * 4/1998 Bennett ..... 52/718.04
D407,829 S * 4/1999 Collette et al. ..... D25/119
5,918,435 A * 7/1999 McGowen ..... 52/311.1
6,036,156 A * 3/2000 Collette et al. ..... 248/345.1
6,053,480 A * 4/2000 De Guise ..... 256/59
6,189,283 B1 * 2/2001 Bentley et al. ..... 52/587.1
6,226,934 B1 * 5/2001 Gaston ..... 52/102
6,257,799 B1 * 7/2001 Ribe ..... 403/402
D448,494 S * 9/2001 Williams ..... D25/119
6,301,857 B1 * 10/2001 Vrana ..... 52/730.1
6,412,249 B1 * 7/2002 Boyer et al. ..... 52/731.9
D465,291 S * 11/2002 Marshall ..... D25/119
D490,543 S * 5/2004 Forbis ..... D25/121
6,796,101 B2 * 9/2004 Chen ..... 52/781
6,964,410 B1 * 11/2005 Hansen ..... 256/24
6,993,883 B2 * 2/2006 Belanger ..... 52/737.3
2001/0025953 A1 * 10/2001 Shepherd ..... 256/24
2004/0065045 A1 * 4/2004 Chen ..... 52/729.2
2005/0017232 A1 * 1/2005 Chen ..... 256/59
2005/0166525 A1 * 8/2005 Moulton ..... 52/698
2006/0180802 A1 * 8/2006 Forbis ..... 256/24

FOREIGN PATENT DOCUMENTS

JP 4-277254 * 10/1992

* cited by examiner

HANDRAIL ASSEMBLY WITH PANEL AND ENGAGING SLEEVES

RELATED APPLICATIONS

This application claims the benefit of U.S. Application Ser. No. 60/683,012 filed on May 20, 2005 and entitled, "HANDRAIL ASSEMBLY." U.S. Application Ser. No. 60/683,012 is incorporated by reference herein in its entirety for all purposes.

FIELD OF THE INVENTION

This invention is directed towards handrail assemblies for use in hallways, stairways, and similar locations.

BACKGROUND OF THE INVENTION

There is enormous variety of various types and materials from which handrails may be constructed. It is well known to use metal tubing which is mounted a spaced distance from a wall for handrails. Similarly, wooden handrails may also be attached to a wall as a handrail.

While handrails have a very functional purpose, there is still a desire to provide a functional yet aesthetic product. To this end, metal handrails may be painted to achieve any desired color. However, handrails are subject to accelerated wear in high traffic areas and require increased maintenance with respect to touch up painting and repair. Similarly, wooden handrails can be stained in a limited number of finishes or painted in a variety of colors. However, high wear areas will result in an ongoing need for periodic maintenance as the finish is compromised by high traffic usage. Further, handrails positioned in high traffic areas often are damaged by deliveries of furniture, supplies, and various moving activities.

Accordingly, there remains a need in the art for economical handrail systems that can be supplied in a variety of colors and finishes and which exhibit superior durability in terms of finish and wear compared to conventional metal or wood handrails.

SUMMARY OF THE INVENTION

It is an aspect of at least one embodiment of the present invention to provide for a handrail assembly system comprising a substantially flat panel having a first pair of grooves defined on opposite sides of the panel and extending an equidistance from an upper edge of the panel; a second pair of grooves positioned on opposite sides of the panel and positioned an equidistance from a lower edge of the panel; a first arcuate sleeve adapted for placement within the first pair of grooves; a second arcuate sleeve adapted for placement within the second pair of grooves; wherein when the sleeves are positioned in the panel a handrail is provided.

It is an additional aspect of at least one embodiment of the present invention to provide for a handrail assembly in which an extruded thermoplastic tube is positioned along an upper surface of a handrail assembly, the extruded tube providing the surface which is gripped by an individual when the handrail is used.

It is an additional aspect of at least one embodiment of the present invention to provide for a curved panel having thermoplastic exterior surfaces and having an upper and a lower respective first and second extruded tube having a curvature adapted for engaging the curved panel within a respective pair of opposing grooves.

These and other objects of the present invention are provided by a handrail assembly system comprising a substantially flat panel having a first pair of grooves defined on opposite sides of the panel and extending an equidistance from an upper edge of the panel; a second pair of grooves positioned on opposite sides of the panel and positioned an equidistance from a lower edge of the panel; a first arcuate sleeve adapted for placement within the first pair of grooves; a second arcuate sleeve adapted for placement within the second pair of grooves; wherein when the sleeves are positioned in the panel, a handrail is provided.

A further aspect of the present invention resides in a handrail assembly that includes a panel with a face. The panel defines a pair of grooves on opposite sides of the panel. A sleeve engages the panel and is at least partially disposed within at least a portion of both of the grooves. A mounting post is present and engages the panel. The mounting post is configured for spacing the panel and the sleeve from an object to which the mounting post is attached.

A further aspect of the present invention exists in a handrail assembly as immediately discussed in which the panel defines a second pair of grooves on opposite sides of the panel. A second sleeve is present and engages the panel. The second sleeve is at least partially disposed within at least a portion of both of the second grooves.

An additional aspect exists in a handrail assembly as discussed above in which the panel is made of particle board. In a further exemplary embodiment, the panel may additionally be made at least partially of a thermoplastic polymer laminate that engages the particle board and forms the face.

An additional aspect of the present invention resides in a handrail assembly that has a plurality of panels. Each of the panels has a face. A plurality of sleeves are present and engage the panels so that at least one of the sleeves engage at least two of the panels. The sleeves engage the panels so as to at least partially cover the tops and bottoms of the panels.

An further aspect exists in a handrail assembly as immediately discussed in which the panels define a first pair of grooves on opposite sides of the panels. At least one of the sleeves is at least partially disposed within at least a portion of both of the first pair of grooves. The panels also define a second pair of grooves on opposite sides of the panels. At least one of the sleeves is at least partially disposed within at least a portion of both of the second pair of grooves.

An additional exemplary embodiment of the present invention resides in a handrail assembly that has a substantially flat panel. The panel defines a first pair of grooves on opposite sides of the panel that extend equidistance from an upper edge of the panel. The panel defines a second pair of grooves positioned on opposite sides of the panel that extend equidistance from a lower edge of the panel. A first arcuate sleeve is present and is adapted for placement within the first pair of grooves. A second arcuate sleeve is also present and is adapted for placement within the second pair of grooves. A handrail is provided once the sleeves are positioned in the panel.

An additional aspect of the present invention resides in a handrail assembly as immediately discussed in which the first and second arcuate sleeves engage the panel and extend beyond a side edge of the panel.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
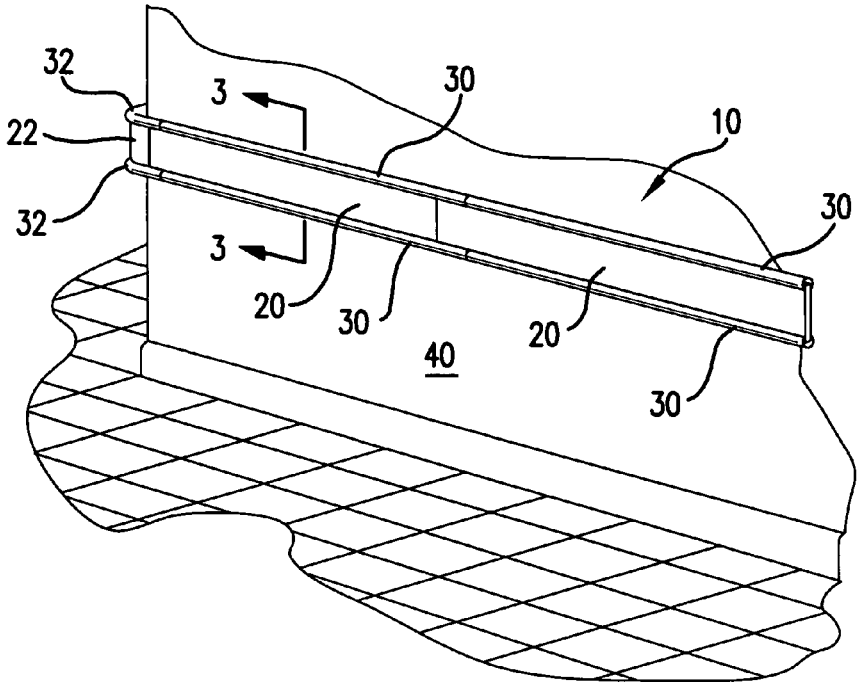
FIG. 1 is a perspective view of a handrail according to the present invention as seen installed along an interior hallway.
Figure 2:
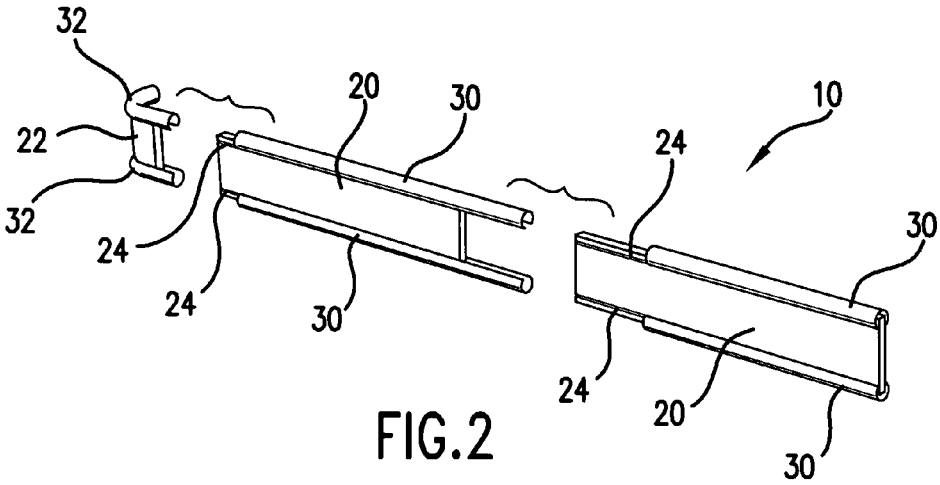
FIG. 2 is an exploded view of an embodiment showing the components of the handrail as seen in partially assembled subunits.

As seen in reference to FIGS. 1 and 2, the handrail assembly 10 is seen which is formed from a plurality of substantially flat panels 20 upon which curved rail members 30 may be attached. As seen in the referenced figures, curved portions 22 and 32 may be provided to accommodate corners and corridor bends as well as variations needed for stairwells as seen in reference to FIG. 6.

Figure 3:
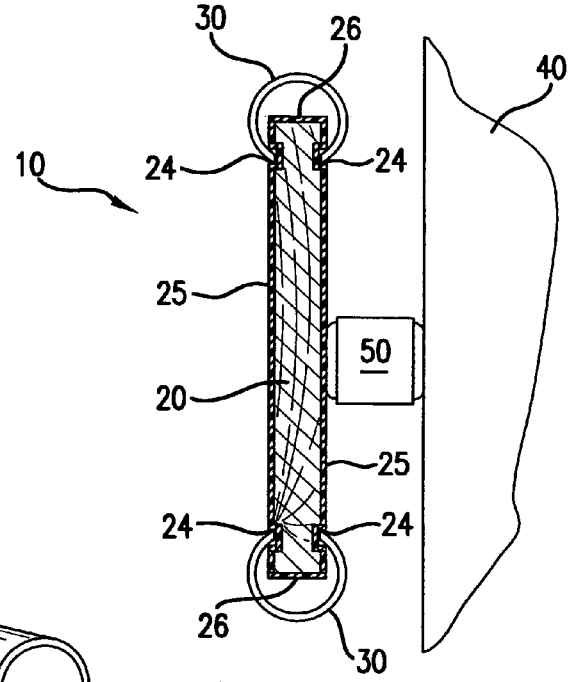
FIG. 3 is a sectional view taken along line 3-3 of FIG. 1.

As seen in reference to FIG. 3, wall 40 may have a mounting post 50 secured thereto using any number of conventional fasteners. Likewise, mounting post 50 may be of any conventional design which is compatible for attaching a handrail of the type and materials as described below.

Figure 4:
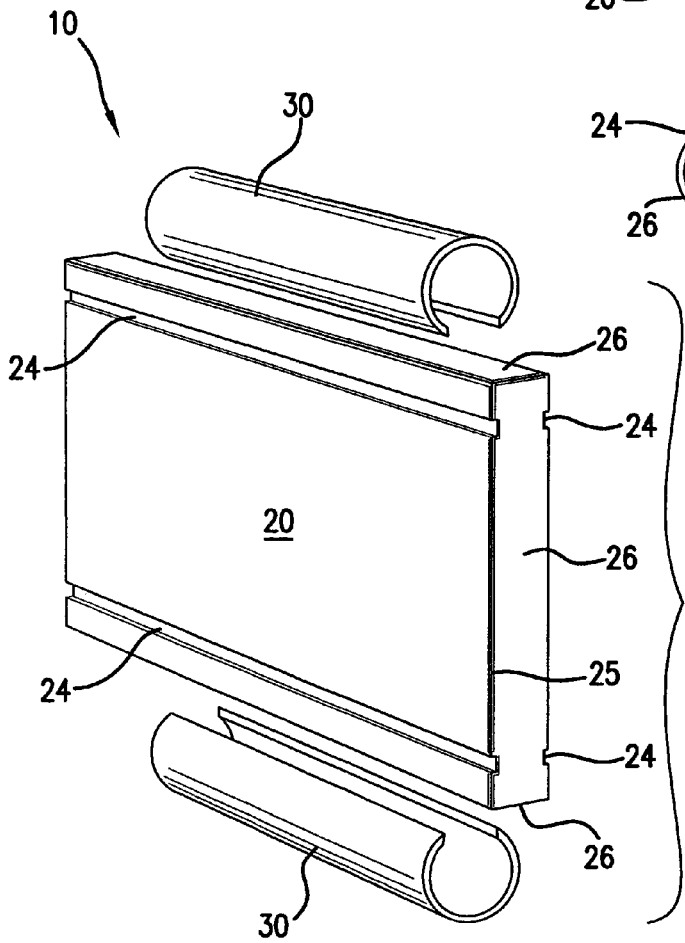
FIG. 4 is an exploded view of an end section of a handrail component piece.
Figure 5:
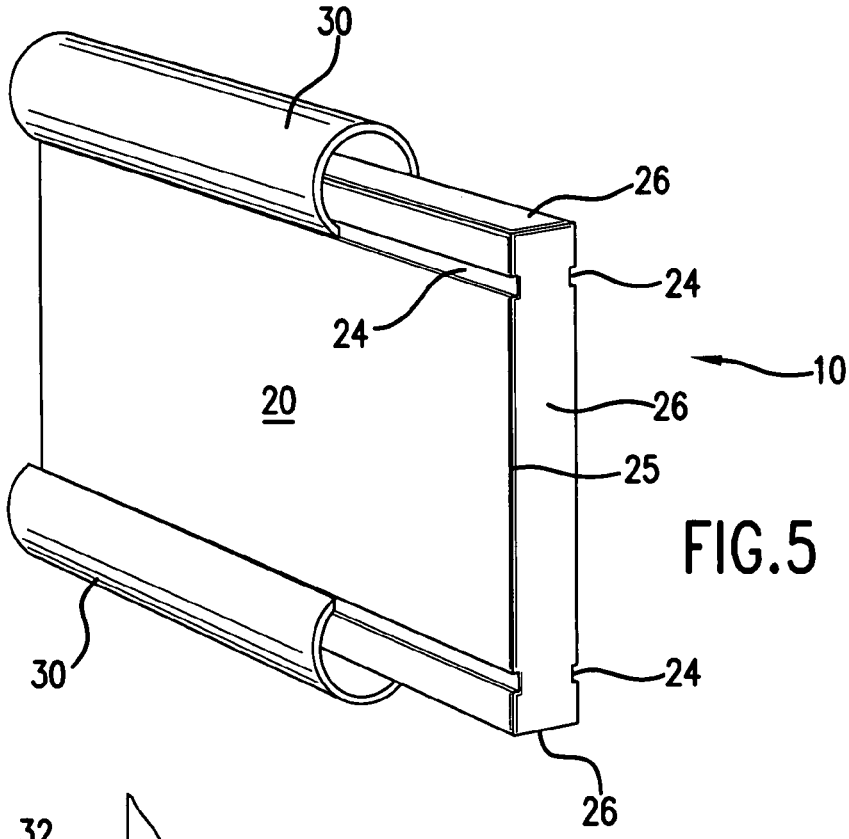
FIG. 5 is a view similar to FIG. 4 showing component parts assembled and positioned onto the handrail.
Figure 6:
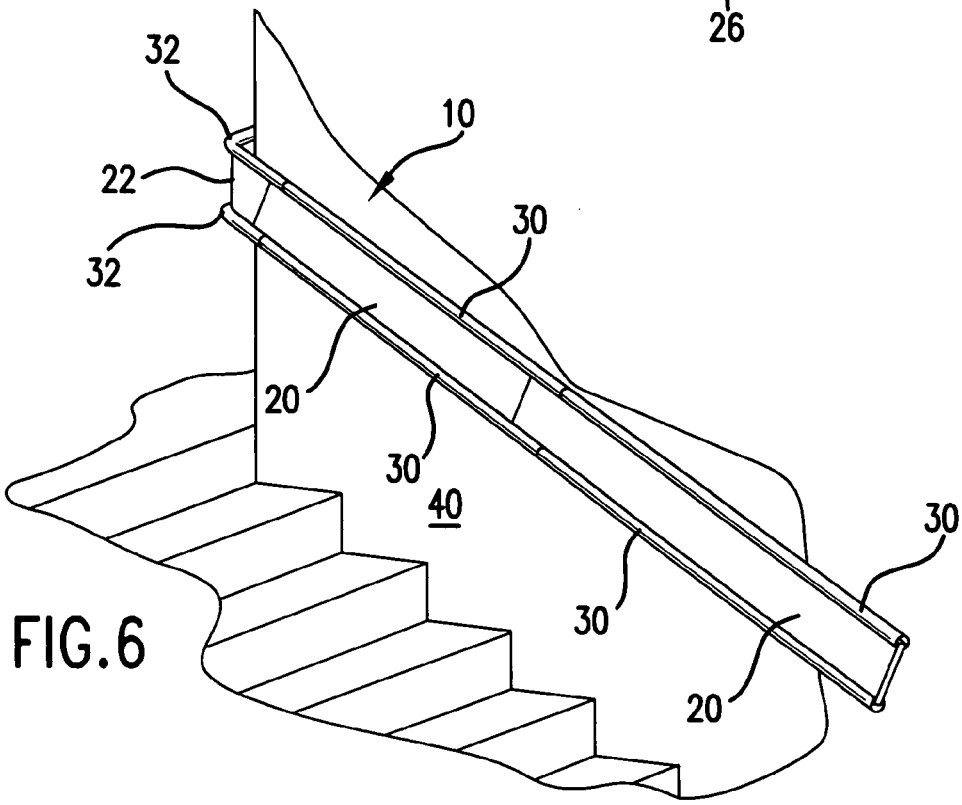
FIG. 6 illustrates the handrail of the present invention modified for traversing a curved portion of a stairwell.
Figure 7:
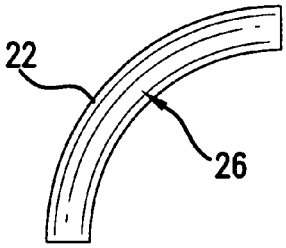
FIG. 7 is a top view of a panel that has a curved face in accordance with one exemplary embodiment.
Figure 8:
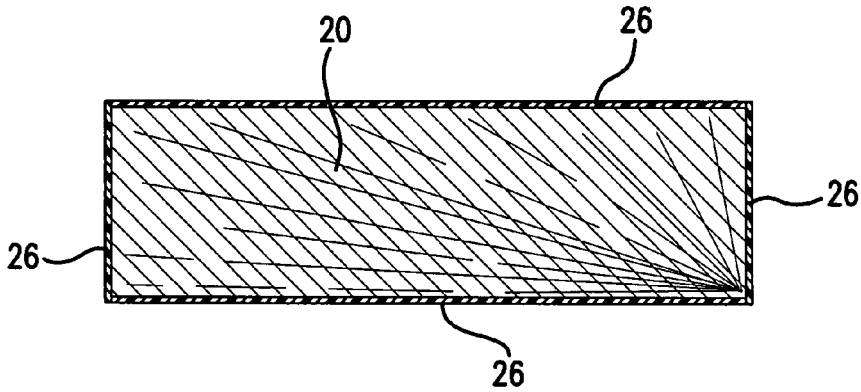
FIG. 8 is a cross-sectional lengthwise view of a panel that has thermoplastic strips located on the top, bottom and side in accordance with one exemplary embodiment.
Figure 9:
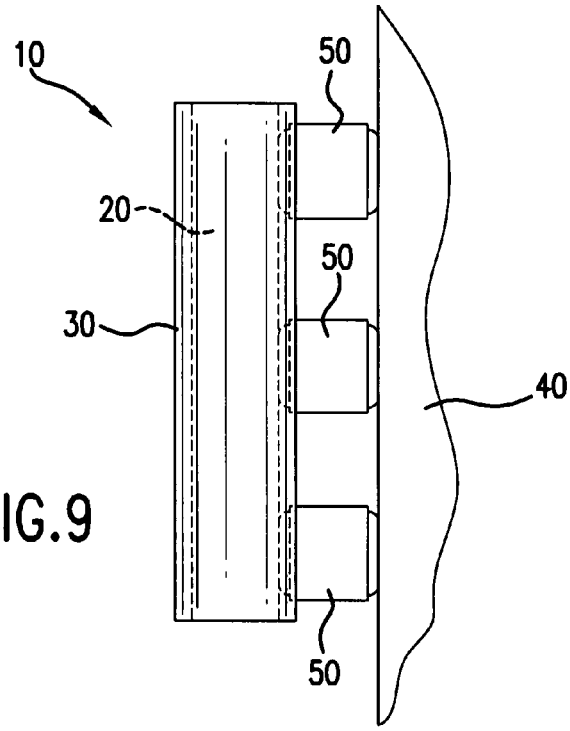
FIG. 9 is a top view of the handrail assembly in which a plurality of mounting posts engage a panel in accordance with one exemplary embodiment.

The component panels 20 and 22 of a handrail as best seen in reference to FIGS. 4 through 6 have a core portion of a compressed wood product such as particle board. The exterior portions of the core particle board have then applied to the exterior surface thermoplastic polymer laminates 25 such as PVC. The PVC panels have a thickness of about 1 to about 3 mm and may be applied with conventional adhesives to the front and rear surfaces of the board 20. Additionally, banding techniques may be used to apply thermoplastic strips 26 to the respective top, bottom, and edge walls of the board 20.

Both a front surface and a rear surface of board 20 have a pair of grooves 24 which are defined within the surface of board 20. As seen in reference to FIGS. 3 through 5, the grooves 24 are positioned equi-distance from the respective top and bottom edges along both the front and rear surfaces of the board. In this manner, a slit piece of polymer tubing 30 may be slid into position along and within grooves 24.

The slit tubing 30 and 32 defines a slit having a width which essentially corresponds to the thickness of the board as measured between the oppositely spaced grooves defined along the front and rear surfaces of board 20 or curved board 22. The slit tubes 30 and 32 have sufficient stiffness such that it is extremely difficult to remove tubing 30 or 32 except by sliding the tubing along an end portion of the handrail. In this manner, it is extremely difficult to snap off or correspondingly to snap on the tubing, thereby preventing removal of the tubing once installed on a handrail.

Various exemplary embodiments exist in which the slit tubes 30 and 32 have an outer surface and an inner surface. The edge of the slit tubes 30 and 32 proximate to the slit in these members may be angled. In this manner, the outer surface extends circumferentially beyond the inner surface so that the edges of the slit tubes 30 and 32 are angled and in effect face in the general direction towards the interior of the slit tubes 30 and 32. The slit tubes 30 and 32 each have two such edges and all of the edges of the slit tubes 30 and 32 may be constructed in a like manner. The angled nature of the edges of slit tubes 30 and 32 function so as to more advantageously nest the slit tubes 30 and 32 into grooves 24 and effect a stronger hold between the slit tubes 30 and 32 and board 20. However, it is to be understood that in other embodiments that one or more of the edges of slit tubes 30 and 32 may be provided so that both the outer and inner surfaces extend circumferentially the same amount at the location of the edge or edges. Further, in other embodiments, the inner surface of the slit tubes 30 and 32 may extend circumferentially beyond the outer surface.

Both the tubing, thermoplastic sheets 25, and thermoplastic strips 26 used to cover the exterior surfaces of boards 20 and 22 are also extruded from polymers such as polyvinylchloride. It is known in the art that extruded sheets, tubing, and edge banding strips of polyvinylchloride may use various pigments to create color combinations including simulated wood grain, marbling, or other patterns extruded during the extrusion process. Since the pigments which make up the extruded article extend throughout the depth of the extruded sheets/tubing, the color and pigmented ornamentation runs the entire depth of the sheet. Accordingly, minor surface abrasions, nicks, burns, or other flaws which may accumulate during use may be easily repaired. Simple techniques such as buffing with fine steel wool may be used to remove abrasions and restore the original appearance of the handrail.

Since the handrail may be supplied as a kit, it is possible to supply additional replacement places of both board and tubing such that a matching color variation may be supplied should more significant repairs be needed or to provide matching handrails exist as a result of remodeling.

As seen in reference to FIG. 1 and FIG. 6, curved board portions 22 and curved tube segments 32 may be provided to allow for turns along hallways as well stairwells. As illustrated in FIG. 2, the board units 20 and tube members 30 do not need to have identical length. In fact, it is believe advantageous to have the tube members 30 meeting adjacent pieces of tubing in locations other than where adjacent pieces of board members 20 are engaged. While not separately illustrated, it is an aspect of one embodiment of the present invention to provide for tube members 30 in which adjacent portions of tubing have opposing, slightly different, dimensions so as to allow one length of tubing to interengage in a nested configuration with the adjacent tubing. This minimizes the prominence of the respective seams between tube members and provides for a smoother surface for the handrail.

While the preferred embodiment of the invention uses particle board as the core of the board 20 and 22, it is recognized that the extruded slit pipes 30 and 32 may be adapted for placement on other substrates including natural boards, metal panels, as well as other similar shaped support members which may be made out of plastic or other materials.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

That which is claimed:

1. A handrail assembly, comprising:

a panel having a face, said panel defining a pair of grooves on opposite sides of said panel, wherein said face defines one of said grooves such that said face has flat portions that lie in the same plane on opposite sides of said groove;

a sleeve engaging said panel and at least partially disposed within at least a portion of both of said grooves, wherein said sleeve has a curved inner surface that has a radius of curvature that is the same about the inner surface of said sleeve, wherein an outer surface of said sleeve is curved and extends circumferentially beyond said inner surface of said sleeve, wherein the portion of said sleeve disposed in said groove defined in said face is located beyond the plane into which said flat portions of said face lie such that said curved outer surface of said sleeve disposed in said groove defined in said face faces a portion of said panel, and such that said curved inner surface of said sleeve disposed in said groove defined in said face faces another portion of said panel; and a mounting post engaging said panel, wherein said mounting post is configured for spacing said panel and said sleeve from an object to which said mounting post is attached.

2. The handrail assembly as in claim 1, wherein said panel defines a second pair of grooves on opposite sides of said panel, and further comprising a second sleeve engaging said panel and at least partially disposed within at least a portion of both of said second grooves.

3. The handrail assembly as in claim 1, wherein said sleeve has an arcuate cross-sectional shape and defines a slit, and wherein the outer surface of said sleeve extends circumferentially beyond the inner surface of said sleeve such that the edges defining said slit are angled.

4. The handrail assembly as in claim 1, wherein said face of said panel is flat.

5. The handrail assembly as in claim 1, wherein said face of said panel is curved, and wherein said sleeve is curved.

6. The handrail assembly as in claim 1, wherein said panel is made at least partially of particle board.

7. The handrail assembly as in claim 6, wherein said panel is made at least partially of a thermoplastic polymer laminate that engages said particle board and forms said face.

8. The handrail assembly as in claim 7, wherein said panel is made at least partially of thermoplastic strips that engage the top wall, bottom wall and at least one edge wall of said particle board.

9. The handrail assembly as in claim 1, wherein said sleeve defines a slit that has a width that is substantially the same as the width of said panel between said pair of grooves.

10. A handrail assembly, comprising:

a plurality of panels, wherein each of said panels has a face; and a plurality of sleeves engaging said panels such that at least one of said sleeves engages at least two of said panels, wherein said sleeves engage said panels so as to at least partially cover the tops and bottoms of said panels, wherein at least one of said sleeves covers a portion of the top of at least one of said panels but does not cover the entire said top, wherein said at least one of said panels defines a pair of first grooves on opposite sides of said at least one of said panels, and wherein said at least one of said sleeves is arcuate in shape and has a curved inner surface and a curved outer surface and has opposite ends disposed in said first pair of grooves such that the only portions of said at least one of said sleeves that contact said at least one of said panels occurs at said first pair of grooves, wherein said face of said panel defines one of said grooves such that said face has flat portions that lie in the same plane on opposite sides of said groove, wherein said end of said sleeve disposed in said groove is located beyond the plane into which said flat portions of said face lie such that said curved outer surface of said sleeve disposed in said groove faces a portion of said panel, and wherein said curved inner surface of said sleeve disposed in said groove faces another portion of said panel.

11. The handrail assembly as in claim 10, wherein all of said panels define a first pair of grooves on opposite sides of said panels and wherein some of said sleeves are at least partially disposed within at least a portion of both of said first pair of grooves; and wherein said panels define a second pair of grooves on opposite sides of said panels and wherein some of said sleeves are at least partially disposed within at least a portion of both of said second pair of grooves.

12. The handrail assembly as in claim 10, wherein said face of at least one of said panels is flat, and wherein said face of at least one of said panels is curved.

13. The handrail assembly as in claim 10, further comprising a plurality of mounting posts engaging said panels, wherein said mounting posts are configured for spacing said panels and said sleeves from an object to which said mounting posts are attached.

14. The handrail assembly as in claim 10, wherein said panels are made of particle board and a thermoplastic polymer laminate that engages said particle board and forms said face of said panels.

15. A handrail assembly, comprising:

a substantially flat panel defining a first pair of grooves on opposite sides of a panel and extending equidistant from an upper edge of said panel, said panel defining a second pair of grooves positioned on opposite sides of said panel and extending equidistance from a lower edge of said panel, wherein said flat panel has a face that defines one of said first pair of grooves such that said face has flat portions that lie in the same plane on opposite sides of said groove;

a first arcuate sleeve adapted for placement within said first pair of grooves, wherein said first arcuate sleeve has an inner surface with a constant radius of curvature about the inner surface, wherein said first arcuate sleeve has a curved outer surface, wherein the only contact along the length of said first arcuate sleeve between said first arcuate sleeve and said panel occurs at said first pair of grooves, wherein the portion of said first arcuate sleeve disposed in said groove defined by said face of said flat panel is located beyond the plane into which said flat portions of said face lie such that said curved outer surface of said first arcuate sleeve disposed in said groove faces a portion of said panel, and such that said curved inner surface of said first arcuate sleeve disposed in said groove faces another portion of said panel; and a second arcuate sleeve adapted for placement within said second pair of grooves;

wherein, when said sleeves are positioned in said panel a handrail is provided.

16. The handrail assembly as in claim 15, further comprising a mounting post that engages said panel, wherein said mounting post is configured for spacing said panel and said sleeves from an object to which said mounting post is attached.

17. The handrail assembly as in claim 15, wherein said first arcuate sleeve and said second arcuate sleeve engage said panel and extend beyond a side edge of said panel.

18. The handrail assembly as in claim 15, wherein said panel is made of particle board and a thermoplastic polymer laminate that engages said particle board.

19. The handrail assembly as in claim 15, wherein said first and second arcuate sleeves each defines a slit, and wherein the outer surfaces of said first and second arcuate sleeves extend circumferentially beyond the inner surfaces of said first and second arcuate sleeves such that the edges defining said slits are angled.

20. The handrail assembly as in claim 15, wherein said first arcuate sleeve and said second arcuate sleeve each define a slit that has a width that is substantially the same as the width of said panel between said first pair of grooves and said second pair of grooves.

* * * * *